United States Patent [19]

Gillette et al.

[11] Patent Number: 4,742,346

[45] Date of Patent: May 3, 1988

[54] SYSTEM FOR APPLYING GREY SCALE CODES TO THE PIXELS OF A DISPLAY DEVICE

[75] Inventors: Glynn G. Gillette, Flemington; Roger G. Stewart, Neshanic Station; John T. Fischer, Princeton, all of N.J.

[73] Assignee: RCA Corporation, Princeton, N.J.

[21] Appl. No.: 943,709

[22] Filed: Dec. 19, 1986

[51] Int. Cl.[4] ..... G09G 3/36

[52] U.S. Cl. ..... 340/793; 340/767; 340/784; 340/805; 340/800; 340/802; 358/241

[58] Field of Search ..... 340/784, 793, 767, 805, 340/703, 802, 801, 800; 358/241, 236, 168, 283

[56] References Cited

U.S. PATENT DOCUMENTS

| | | | |
|---|---|---|---|
| 4,180,813 | 12/1979 | Yoneda | 340/784 |
| 4,210,934 | 7/1980 | Kutaragi | 358/241 |
| 4,353,062 | 10/1982 | Lorteije et al. | 340/767 |
| 4,427,978 | 1/1984 | Williams | 340/784 |
| 4,429,305 | 1/1984 | Hosokawa et al. | 340/784 |
| 4,554,539 | 11/1985 | Graves | 340/805 |
| 4,571,584 | 12/1986 | Suzuki | 340/784 |

*Primary Examiner*—John W. Caldwell, Sr.
*Assistant Examiner*—Edwin C. Holloway, III
*Attorney, Agent, or Firm*—E. M. Whitacre; D. H. Irlbeck; L. L. Hallacher

[57] ABSTRACT

A system for applying grey scale codes to a display device having a plurality of columns of pixels, has a segmented shift register, with one shift register segment for each pixel column. Data stored in the shift register segments are transferred to counters through multiplex circuitry. The counters control transfer gates by which voltages are applied to the pixel columns.

2 Claims, 3 Drawing Sheets

SYSTEM FOR APPLYING GREY SCALE CODES TO THE PIXELS OF A DISPLAY DEVICE

BACKGROUND

This invention relates generally to transfer circuits and particularly to a system for applying grey scale codes to the pixels of a display device.

Many display devices, such as liquid crystal displays, are composed of a matrix of active elements, or pixels, arranged vertically in columns and horizontally in rows. The data to be displayed are applied as drive voltages to data lines which are individually associated with each column of active elements. The rows of active elements are sequentially scanned and the individual active elements within the activated row are illuminated to grey scale levels in accordance with the levels of the drive voltages applied to the various columns. Typically in a display device the grey scale levels are received as an analog video signal. The analog signal is applied to an analog-to-digital converter (A/D) to place the brightness signals in digital format. A digital code is thus provided for the brightness level for each of the columns of active elements within the display device. Liquid crystal displays for color television, or high quality display devices, typically include 250,000 to 750,000 liquid crystals. Typically, the display includes 1,440 vertical columns and approximately 175 to 520 horizontal rows, depending upon the size of the display. Accordingly, actuating each column of active elements with an individual brightness signal requires 1,440 output lines from the digital circuitry. Providing 1,440 output lines on a standard liquid crystal matrix is a formidable task because of physical constraints. Also, the incoming data are stored in shift registers prior to being transferred to the display matrix. The physical constraints also make it very difficult to provide 1440 separate shift registers which are serially unloaded. For these reasons there is a need for a system for rapidly applying a large number of digital grey scale codes to the columns of active elements of a display device. The present invention fulfills this need.

CROSS-REFERENCE TO RELATED APPLICATION

The present invention can be used along with the invention described in U.S. application Ser. No. (RCA 83,007) entitled "Display Device Drive Circuit" filed on even date herewith by Glenn Gillette, Roger G. Stewart and John T. Fischer.

SUMMARY

A system for applying a plurality of digital grey scale codes to the pixels of a display device composed of an array of pixels arranged vertically in Y columns and horizontally in rows includes shift register means for receiving and storing the grey scale codes for the columns. The shift register has Y shift register segments whereby each segment stores the grey scale codes for a particular column and provides the grey scale codes to the particular column. A plurality of Y multiplex means are individually responsive to the shift register segments for receiving the grey scale codes. A plurality of counters are individually responsive to the multiplex means whereby the grey scale codes are transferred from the shift register segments to the counters to set the counters to counts equal to the grey scale codes whereby the counters count down from the set counts to zero. A plurality of transfer circuits are individually responsive to the counters. The transfer circuits are conductive when the counters are counting and nonconductive after the counters have counted to zero whereby the transfer circuits are conductive in accordance with the number of grey scale codes received from the shift register segments.

DETAILED DESCRIPTION

Figure 1:
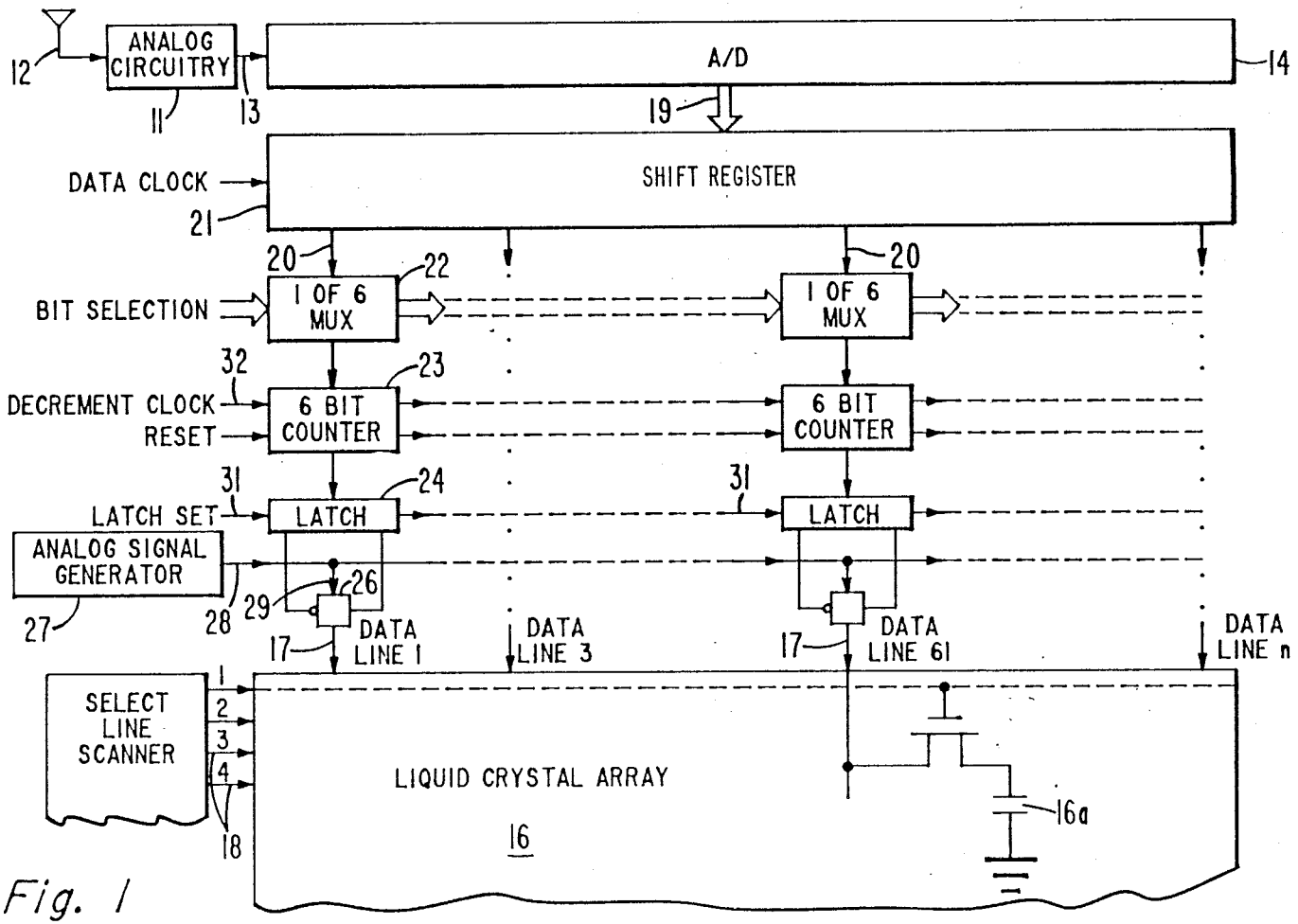
FIG. 1 shows a display device drive circuit with which the present invention can be used.

FIG. 1 shows a system with which the present invention can be used. In FIG. 1, analog circuitry 11 receives a signal representative of the data to be displayed from an antenna 12. When the incoming signal is a television video signal, the analog circuitry 11 is standard television receiver circuitry of a type well known to those skilled in the art. The analog circuitry 11 provides an analog, data bearing signal, on a line 13 as an input signal to an analog-to-digital converter (A/D) 14. The television signal from the analog circuitry 11 is to be displayed on a liquid crystal array 16, which is composed of a large number of picture elements, such as the liquid crystal **16*a*, arranged horizontally in rows and vertically in columns. Liquid crystal displays for color television, or high quality data displays, typically include 250,000 to 750,000 liquid crystals. Typically, the display includes 1440 vertical columns and, approximately 175 to 520 horizontal rows, depending upon the size of the display. In FIG. 1, the liquid crystal array 16 includes one column drive line 17 for each of the vertical columns, and one line select input lead 18 for each of the horizontal rows. The analog-to-digital converter 14 includes an output bus 19, to provide grey scale codes to a digital storage means 21, preferably a shift register, having a plurality of output lines 20 equal in number to the number of active element columns. The output lines 20 of the shift register 21 control the voltages applied to the column drive lines 17 for the columns of liquid crystals 16*a* through multiplex means 22, counter means 23, and transfer circuit means including latch circuits 24, and transfer gates 26. Each of the output lines 20, therefore, controls the voltage applied to the liquid crystals in a particular column when the associated transfer gate 26 is on, and in accordance with the scanning of the select input lines 18. The shift register 12** is described in more detail hereinafter with respect to FIG. 2.

The shift register 21 stores the brightness levels which are representative of the brightness with which the liquid crystals in the respective columns are to be illuminated. When a six bit grey scale is desired, i.e. sixty four brightness levels, each of the digital brightness signals is a binary word representative of one of the sixty four grey scale brightness levels and the shift register 21 includes a six bit register for each column. The binary representations of the grey scale levels for each column are simultaneously transferred through the multiplex circuits (MUX) 22 to the six bit counters 23. Each of the six bit counters 23 is thereby set to a brightness count representative of the desired grey scale brightness level. The latches 24 control the conduction of the transfer gates 26 in accordance with the counts set into the counters 23. A latch set signal is applied to all the latches 24 by a latch set line 31. When the latches are set, the outputs are high and the transfer gates 26 are conductive, or on. The latches remain set until the associated counter 23 decrements to zero, at which time the latch 24 changes state and the output goes low to render the associated transfer gate 26 nonconductive, or off.

An analog signal generator 27, which preferably is a ramp generator, has a master output bus 28 coupled to the column drive lines 17 by additional input lines 29 and through the transfer gates 26. Accordingly, when the transfer gate 26 of a particular column is turned on, because the count in the associated counter 23 has not decremented to zero, the liquid crystal cells within the column receive a voltage level determined by the level of the analog signal from the signal generator 27. Thus, at a given instant all turned on columns receive the same analog drive voltage.

Briefly stated, in operation, during the first line period the six bit grey scale code for each picture element for one horizontal line of the array 16 is loaded into the shift register 21. At the end of the line period, the horizontal line data are rapidly transferred from the shift register 21 to the six bit counters 23 for every vertical column. A latch set signal is applied to all the latches 24 by the latch set input line 31 and all the transfer gates 26 are turned on. During the second line period two operations take place. The grey scale data for the next line period are loaded into the shift register 21. Simultaneously, the analog signal generator 27 ramps the master output bus 28, and every "turned on" column within the liquid crystal array 16 is biased to the same level as the level of the analog signal on the master output bus 28. Thus, in a given instance, all of the columns within the array receive the same driver voltage from the signal generator 27 and the output of the signal generator 27 contains no display information. The analog voltages presented to the data input lines 17, therefore, are dependent solely upon the contents of the respective six bit counters 23. The counters 23 are decremented by a clock input on an input line 32 and each of the counters 23 begins counting toward zero while the analog signal generator simultaneously ramps the master output bus 28 and the "turned on" columns of active elements in the array to higher voltages. When a counter reaches the count of zero, the associated latch 24 is reset and turns off the transfer gate 26. The liquid crystal cell within the "turned off" column no longer receives the analog signal on the master output bus 28 and remains charged to the level which existed on the output bus 28 when the associated counter decremented to zero and turned off the respective transfer gate 26.

Figure 2:
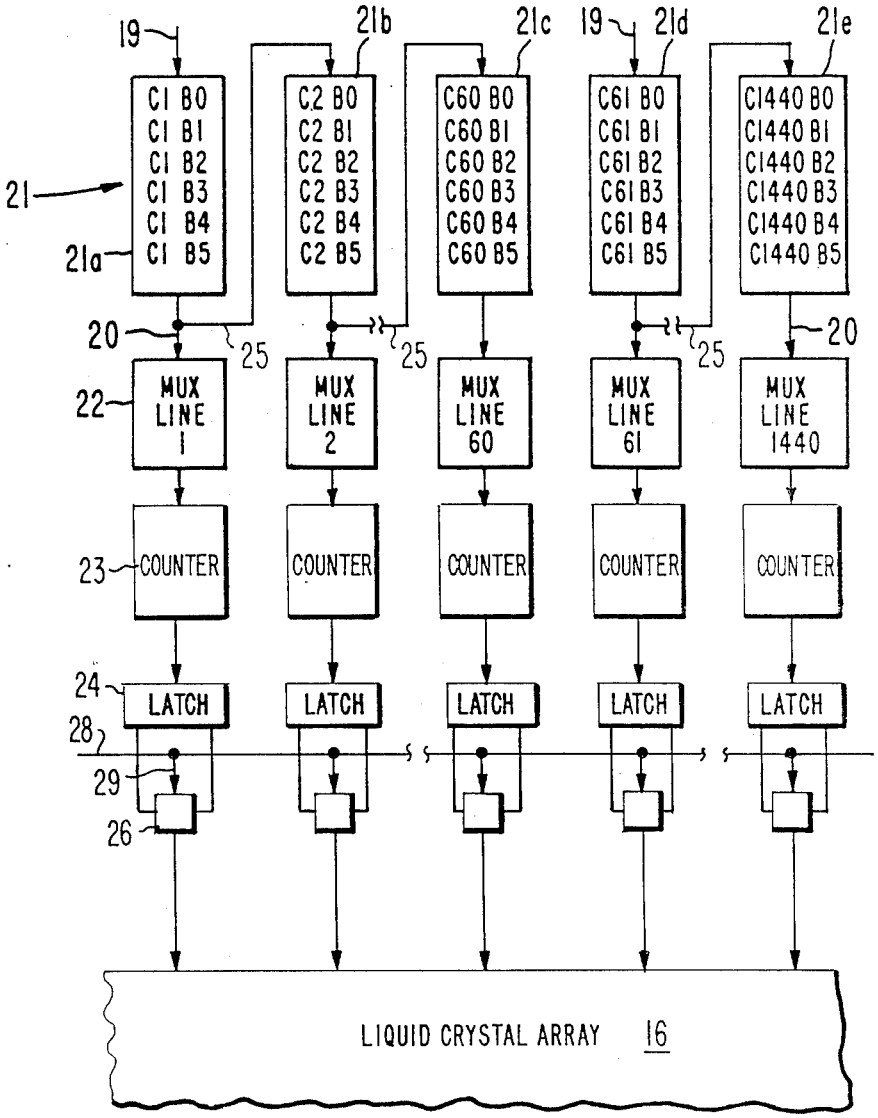
FIG. 2 shows the shift register of FIG. 1 in more detail.

FIG. 2 shows the shift register 21 in more detail. When a six bit grey scale is used, and the display has 1440 columns, driving the array 16 requires 1440 six bit registers. The time required for loading the registers, the power requirements and the number of lines 19 from the A/D 14 to the shift register 21 can be minimized by segmenting the shift register into six bit segments, a portion 21*a* to 21*e* of which are shown, and connecting the segments into groups. Thus, each group includes sixty serially connected six bit segments, and the full display requires twenty four such groups. Each group is coupled to the A/D 14 by a line 19, and the number of lines from the A/D 14 is reduced from 1440 to 24. Six bit registers are used because six grey scales are intended, as the number of grey scales changes the storage capacity of the registers similarly changes. As shown in FIG. 2, the first group of the twenty-four groups of registers includes 60 six bit serially loaded register segments, three of which are designated as 21*a*, 21*b* and 21*c*. The first register segment 21*a*, is coupled to the-first column of liquid crystals 16*a*, and receives an input from the A/D 14. Register segment 21*b* is coupled to the second column of crystals, and register segment 21*c* is coupled to the sixtieth column of crystals. The six bit registers within each group of twentyfour are serially loaded, as demonstrated by the lines 25. The output line 20 of each of the register segments is coupled to the associated multiplex circuit 22. The remainder of the register segments are indicated as 21*d* and 21*e*. The register segment 21*d* represents the shift register segment for the sixty-first column of crystals and, thus, is the first register segment within the second group of segments. This register segment also receives an input from A/D 14 via a line 19. The register segment 21*e* represents the register segment associated with the last, or 1440th, column. The segmented configuration of the shift register 21 results in several advantages. Only twentyfour output lines 19 from the A/D 14 are needed, but 1440 input lines 17 are available to the columns of active elements in the liquid crystal array 16. For this reason, the transfer of data from the A/D 14 to the register 21 requires a substantial amount of time. However, the transfer occurs while the data for the preceding line are being transferred to, and displayed upon, the array 16 and, thus, substantial time is available. Also, because 1440 of the output lines 20 are available to the counters 23, the transfer of data to the counters is very rapid.

Figure 3:
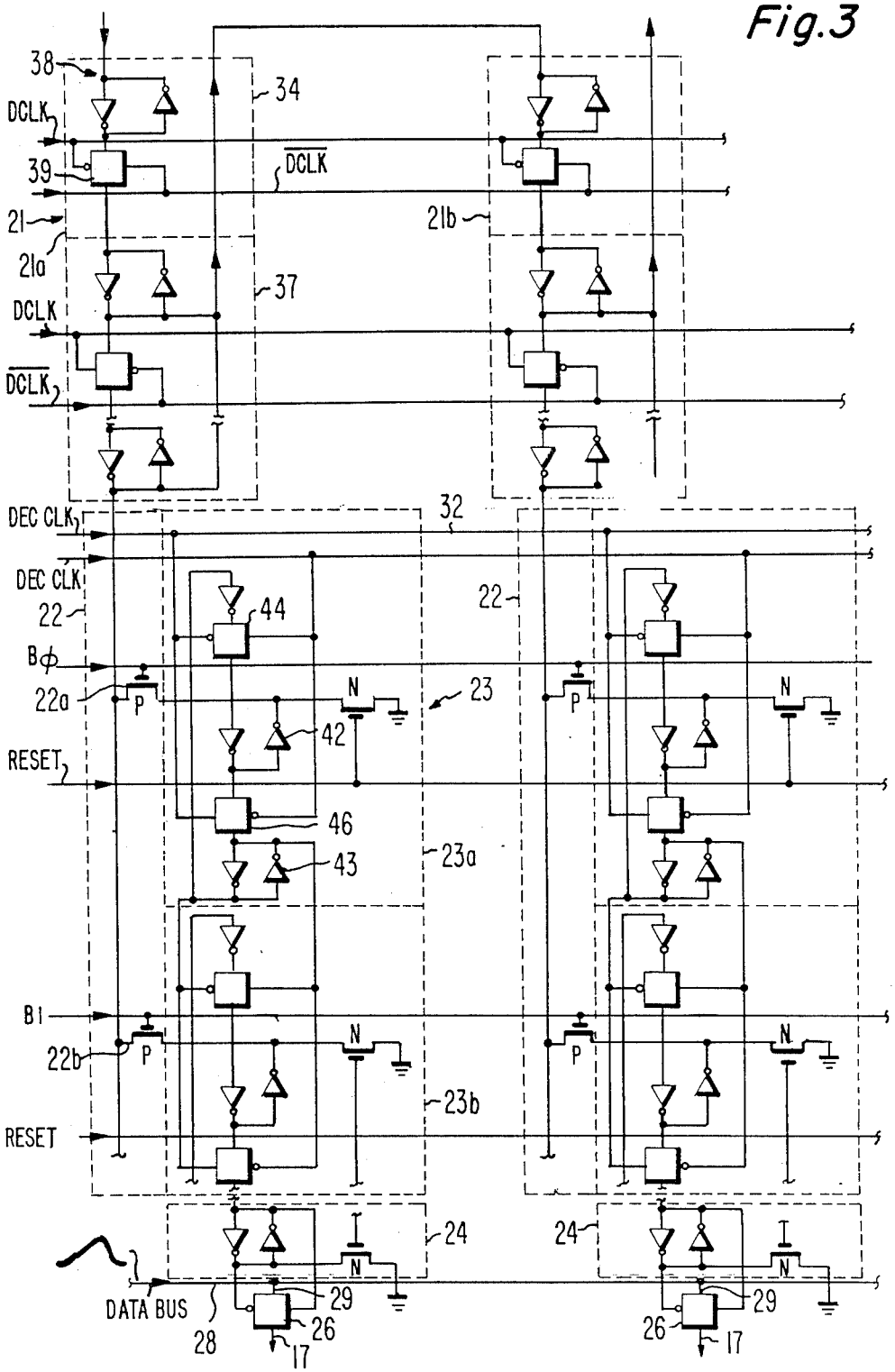
FIG. 3 is a preferred embodiment of a system for applying grey scale codes to the columns of active elements of the display device in FIG. 1.

FIG. 3 shows the shift register segments 21, the multiplex circuits 22, the counters 23, and the latch circuits 24 in more detail. Two shift register segments 21*a* and 21*b* are shown, with each segment having two storage stages shown. Thus, the segment 21 includes two storage stages 34 and 37. As stated hereinabove with respect to FIG. 2, each of the shift register segments includes six storage stages when a six bit grey scale code is to be utilized, accordingly the two stages 34 and 37 are exemplary and the other four stages are omitted for simplicity. The first storage stage 34 of the shift register segment 21*a* includes a latch circuit 38 and a transmission gate 39, both of which are well known to those skilled in the art. The output of the latch circuit 38 is applied to the next stage 37 of the shift register segment 21*a* through the transmission gate 39. The other four stages of the segment 21*a* are similarily connected to transfer the grey scale codes to the counters 23 through the MUX circuits 32.

The counter circuits 23 each include a plurality of stages 23*a*, 23*b*, etc., one for each grey scale code, which are coupled to the shift register stages by way of the multiplex circuits 22. The multiplex circuits 22 include thin film transistors 22*a*, 22*b*, etc., one for each bit of the grey scale code. Each of the counter stages includes two latch circuits 42 and 43 and two transmission gates 44 and 46, both of which are standard components known to those skilled in the art. The latch circuits and transmission gates are coupled in the configuration of a ring counter, known to those skilled in the art. The data from the shift register segments are transferred to the counter stages by appropriately clocking the clock lines CLK and the B0, B1, etc. select lines of the multiplex circuits 22.

The data stored in the shift register segments are transferred serially from the shift register segments to the counter stages. However, the transfer from the shift register segments to the counters occur simultaneously for all the columns and therefore the transfer of data from the shift register segments to the column counters is very rapid. The loading of the shift register segments is done serially as shown and described with respect to FIG. 2. Accordingly, the loading of the shift registers requires a substantial period of time, as compared to the transfer of the data from the shift register segments to the counters. Because the transfer of data to the shift register segments occurs during the preceding line time, a substantial amount of total line time is available for such data transfer. Also, because the transfer of data from the shift register segments to the counters, and because the transfer of data from all of the counters to all of the columns of active elements occurs simultaneously, such data transfer is very rapid. The invention is also advantageous because the number of lines from the A/D converter 14 to the shift register is minimized. The spacing between adjacent column driver lines 17 is very small, and is limited by the size of the liquid crystals 16*a*. With the invention, the number of lines required from the A/D is reduced from 1446 to 24, and the spacing problem ordinarily associated with such driver lines is alleviated.

What is claimed is:

1. A system for applying a plurality of digital grey scale codes to the pixels of a display device composed of an array of pixels arranged vertically in Y columns and horizontally in rows comprising:

shift register means for receiving and storing said grey scale codes for said columns, said shift register means having a plurality of groups, each of said groups having a plurality of segments whereby said shift register means includes Y shift register segments and each segment stores said grey scale codes for a particular column and provides said grey scale codes to said particular column;

a plurality of Y multiplex means individually responsive to said shift register segments for receiving said grey scale codes;

a plurality of counters individually responsive to said multiplex means for receiving said grey scale codes from said shift register segments to set said counters to counts equal to said grey scale codes whereby said counters count down from said counts to zero; and a plurality of transfer circuit means, each of said transfer circuit means including a latch circuit responsive to one of said counters and a transfer gate responsive to said latch circuit, said transfer gates being conductive when said counters are counting and nonconductive after said counters have counted to zero whereby said transfer gates are conductive in accordance with the grey scale codes received from said shift register segments.

2. The system of claim 1 wherein pixels are liquid crystals.

* * * * *